US006591647B2

(12) United States Patent
Gerard

(10) Patent No.: US 6,591,647 B2
(45) Date of Patent: Jul. 15, 2003

(54) METHOD FOR MANUFACTURING A CORRUGATED FIN FOR A PLATE-TYPE HEAT EXCHANGER AND DEVICE FOR IMPLEMENTING SUCH A METHOD

(75) Inventor: Claude Pierre Gerard, Chantraine (FR)

(73) Assignee: Nordon Cryogenie SNC, Golbey (FR)

( * ) Notice: Subject to any disclaimer, the term of this patent is extended or adjusted under 35 U.S.C. 154(b) by 43 days.

(21) Appl. No.: 09/897,440

(22) Filed: Jul. 3, 2001

(65) Prior Publication Data

US 2002/0002853 A1 Jan. 10, 2002

(30) Foreign Application Priority Data

Jul. 4, 2000 (FR) ..... 00 08693

(51) Int. Cl.[7] ..... B21D 13/02; B21D 28/26

(52) U.S. Cl. ..... 72/17.3; 72/335; 72/384; 72/385

(58) Field of Search ..... 72/17.3, 335, 294, 72/385, 384; 29/896.6, 890.03

(56) References Cited

U.S. PATENT DOCUMENTS

| | | | | |
|---|---|---|---|---|
| 3,009,510 A | * | 11/1961 | Meshulam | 72/385 |
| 3,828,705 A | * | 8/1974 | Morrison | 72/385 |
| 3,835,689 A | * | 9/1974 | Antonenko et al. | 72/385 |
| 3,986,470 A | * | 10/1976 | Berry et al. | 72/335 |
| 4,869,316 A | * | 9/1989 | Yoshida et al. | 165/151 |

FOREIGN PATENT DOCUMENTS

| | | |
|---|---|---|
| DE | 24 23 559 | 11/1975 |
| EP | 0 658 383 | 6/1995 |
| EP | 0 776 711 | 6/1997 |

* cited by examiner

*Primary Examiner*—Daniel C. Crane
(74) *Attorney, Agent, or Firm*—Young & Thompson

(57) ABSTRACT

A method of manufacture includes the steps of making perforations using a perforating tool in a flat product before it is bent; making bends using a bending tool in the perforated flat product; detecting the position of a perforation on the corrugation; and slaving the relative position of tools to the detected position.

10 Claims, 5 Drawing Sheets

METHOD FOR MANUFACTURING A CORRUGATED FIN FOR A PLATE-TYPE HEAT EXCHANGER AND DEVICE FOR IMPLEMENTING SUCH A METHOD

BACKGROUND OF THE INVENTION

The present invention relates to a method for manufacturing, from a flat product in sheet form, a corrugated fin for a plate-type heat exchanger, of the type defining a main overall direction of corrugation and comprising at least one corrugation which is more or less transverse to the said main overall direction, the said corrugation having corrugation legs connecting corrugation crests and corrugation troughs, the said corrugation having a series of perforations.

FIG. 1 of the appended drawings depicts, in perspective, with partial cut away, one example of such a heat exchanger, of conventional structure, to which the invention applies. This may, in particular, be a cryogenic heat exchanger.

The heat exchanger 1 depicted consists of a stack of parallel rectangular plates 2, all identical, which define between them a number of passages for fluids to be placed in an indirect heat-exchange relationship. In the example depicted, these passages are, successively and cyclically, passages 3 for a first fluid, 4 for a second fluid and 5 for a third fluid.

Each passage 3 to 5 is bordered by closure bars 6 which delimit it, leaving inlet/outlet openings 7 free for the corresponding fluid. Placed in each passage are corrugated spacer pieces or corrugated fins 8 which act simultaneously as heat-exchange fins and as spacer pieces between the plates, particularly during the brazing operation and to avoid any deformation of the plates when pressurized fluids are used, and serve to guide the flow of the fluids.

The stack of plates, closure bars and corrugated spacer pieces is generally made of aluminium or aluminium alloy and is assembled in a single operation by furnace brazing.

Fluid inlet/outlet boxes 9, of semi-cylindrical overall shape, are then welded onto the exchanger body thus produced, to cap the corresponding rows of inlet/outlet openings, and are connected to pipes 10 for conveying and removing the fluids.

There are various types of corrugated spacer pieces 8 in existence, for example a simple perforated corrugated spacer piece such as the one depicted in FIG. 2.

Throughout the description, reference will be made to this type of simple perforated corrugation, it being clearly understood that the invention applies to many other more complex types of corrugation, for example of the "serrated fin" or "partial offset" type in which, at regular intervals along the generators, the corrugation is offset transversely, generally by half a corrugation pitch, "chevron corrugations" or "herringbone corrugations", with corrugated generators, "slatted corrugations", the legs of the corrugations of which exhibit lancings, etc.

The simple perforated corrugation has a main overall direction of corrugation Dl, the corrugations being oriented in a direction D2 perpendicular to the direction D1. In "herringbone" corrugations, D1 is taken to be the mean direction of the corrugation.

For the convenience of the description, it will be assumed that, as depicted in FIG. 2, directions D1 and D2 are horizontal.

The corrugation 8 has a crinkled shape and comprises a great many rectangular corrugation legs 12, each contained in a vertical plane perpendicular to the direction D2. With respect to an overall direction F of the flow of the fluid in the direction D1 in the passage in question, each leg has a leading edge 13 and a trailing edge 14. The legs are connected alternately along their upper edge by flat and horizontal rectangular corrugation crests 15 and along their lower edge by corrugation troughs 16 which are also rectangular, flat and horizontal.

Perforations 20 are made in the corrugation legs, so as to introduce turbulence into the flow of the fluid through the heat exchanger, and thus encourage heat exchange.

In order to manufacture corrugated fins of the type which has just been described, the general procedure is as follows: the perforations are made, using a perforating tool, in the flat product before it is bent, and the bends are made, using a bending tool, in the perforated flat product. These operations are carried out in succession and discontinuously, which means that the flat product is extracted from the first tool after perforation, and before being processed in the second tool, because processing the flat product continuously in the two tools is made difficult by the difference in speed of travel of the flat product corresponding to each of these two tools.

Furthermore, the slippage of the flat product in the bending tool after perforation and its elongation are difficult to control, and this gives rise to significant variations in the positioning of the perforations with respect to the bend.

This leads to thermal properties which are not very uniform and difficult to control. In addition, if the perforations are distributed over the entire surface of the flat product, the area of the contact between the corrugation crests and troughs, on the one hand, the adjacent plates 2 on the other hand, are not constant. In consequence, the resistance of the brazed connections to tearing out and the transfers of heat between the corrugations and the plates are not controlled.

SUMMARY OF THE INVENTION

With the prime objective of overcoming these drawbacks, the invention relates to a method of manufacture of the type described hereinabove, in which:

- the product is made to pass step by step between the perforating tool and the bending tool, the relative position of the said tools being variable in the direction of travel of the flat product;
- the position of a perforation on the corrugation is detected; and
- the relative position of the tools is slaved to the detected position.

The invention also relates to a device for implementing a method as described hereinabove, comprising a perforating tool and a bending tool each having an entry and an exit, the assembly formed by the perforating tool and the bending tool constituting treatment line intended to process a flat product, characterized in that the treatment line processes the flat product continuously, the exit of the perforating tool being connected to the entry of the bending tool, and the relative position of the perforating tool and of the bending tool in the direction of travel of the flat product through the treatment line is adjustable via command and control means.

The invention additionally relates to the use of a method or of a device both as described hereinabove for producing corrugated fins of hybrid structure, in which perforations are arranged in spaced-apart transverse bands of the flat product, these bands being separated by non-perforated bands or alternatively for producing corrugated fins having notched offset corrugations on at least some leading edges and/or at least some trailing edges of the corrugation legs and possibly of the corrugation troughs and/or crests.

Figure 1:
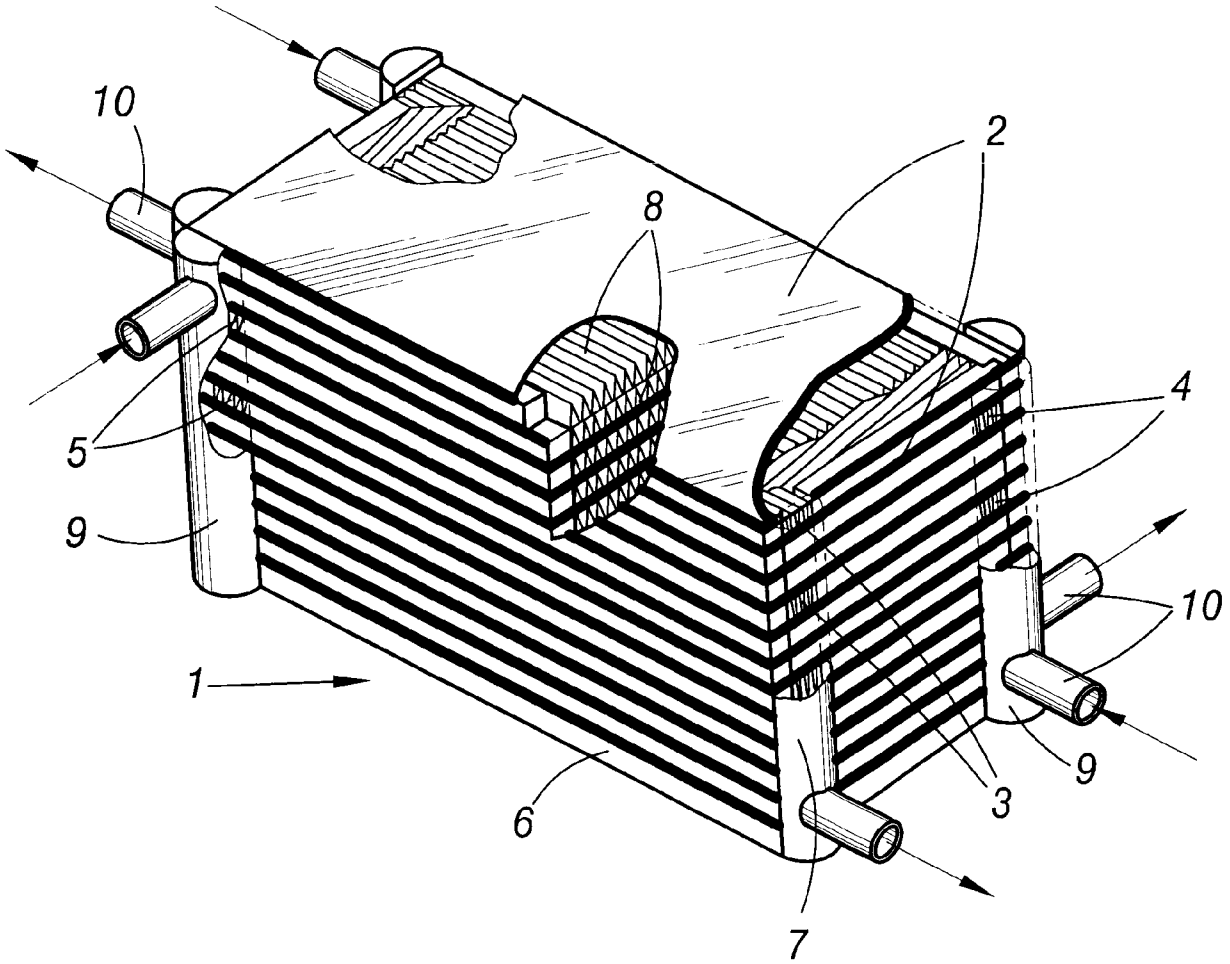
FIGS. 1 to 2 show a cut-away of a heat exchanger and a corrugated spacer.
Figure 2:
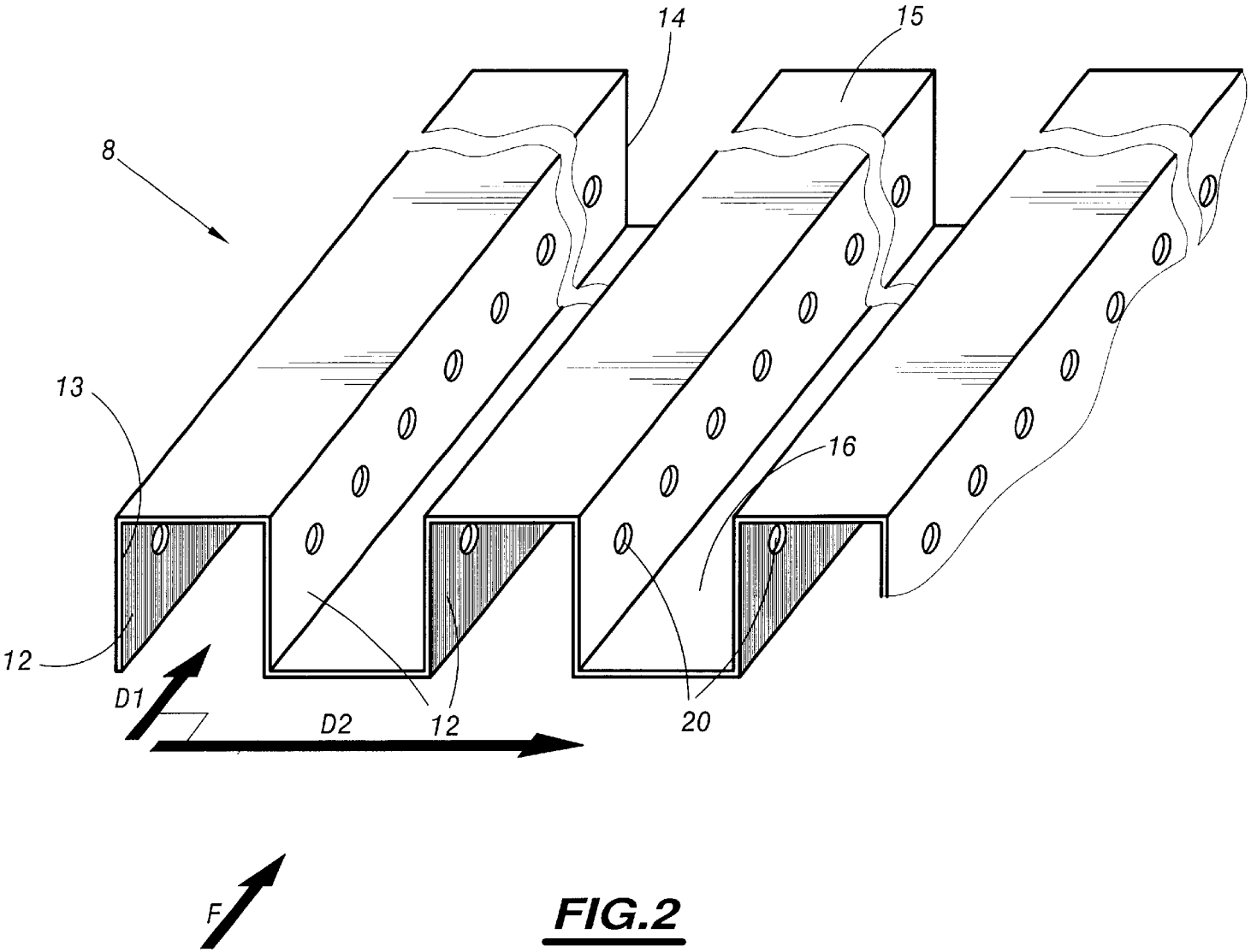
Figure 3:
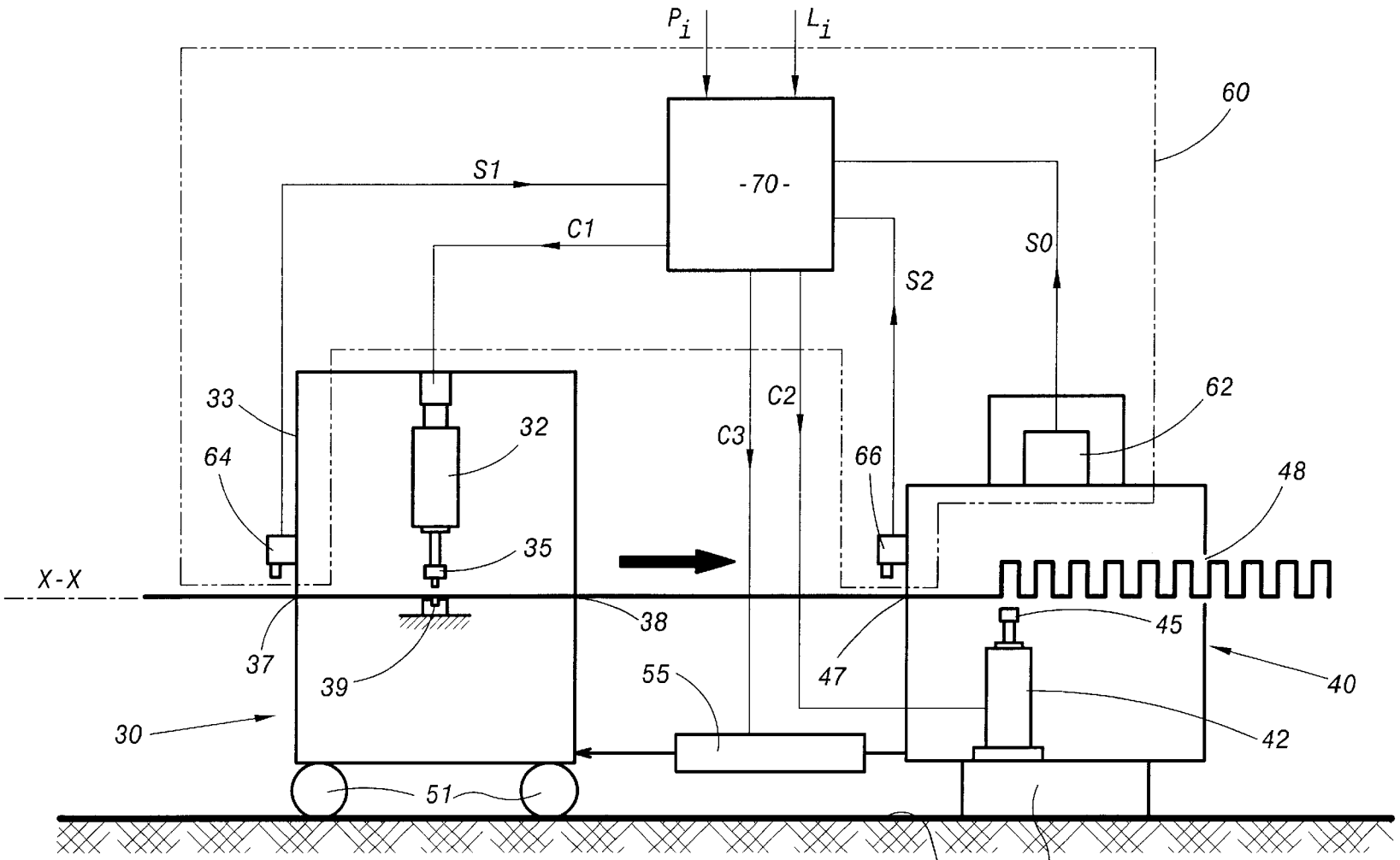
Figure 4:
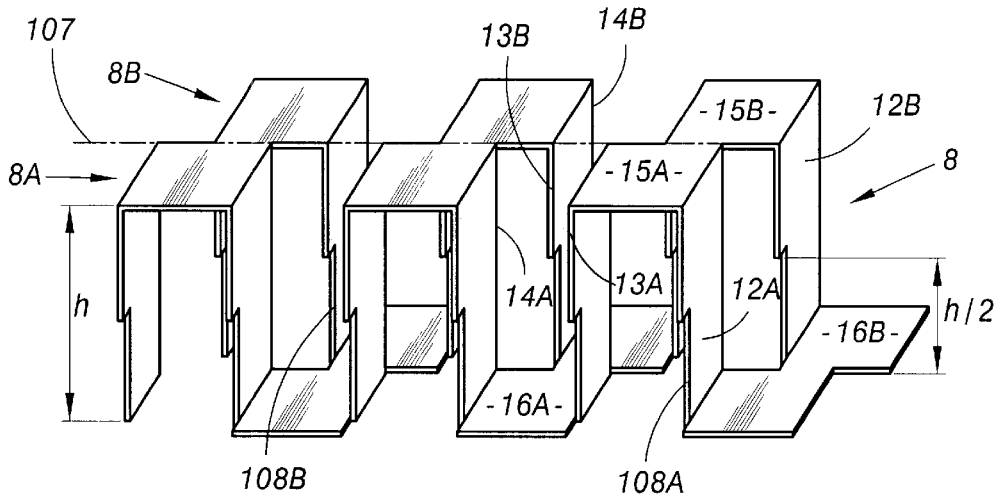
Figure 5:
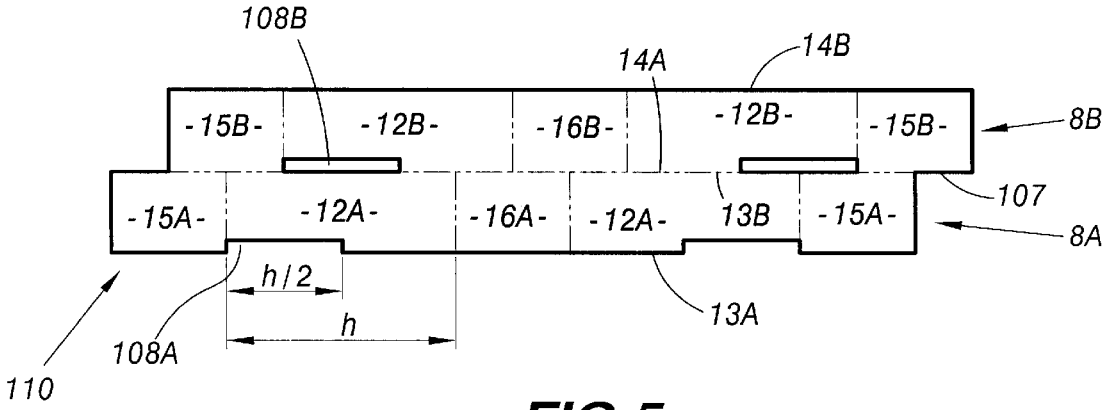
Figure 6:
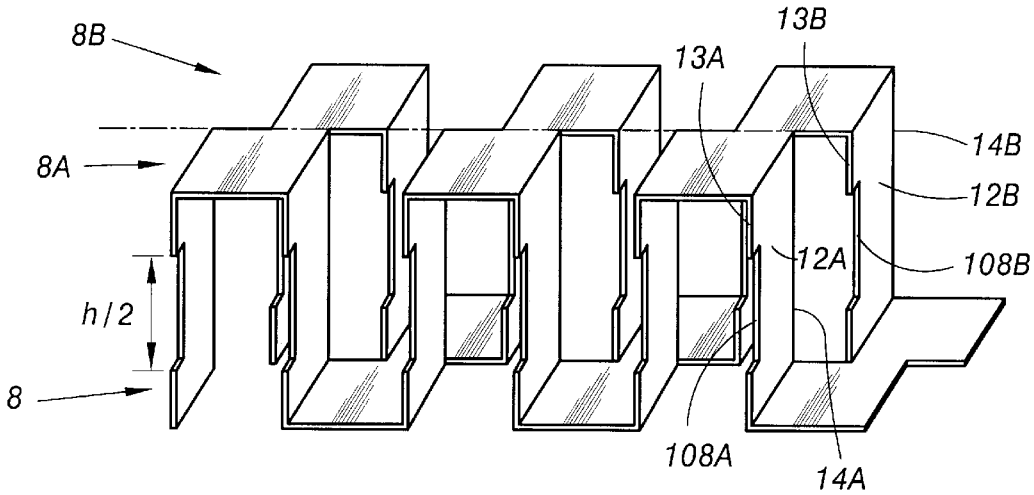
Figure 7:
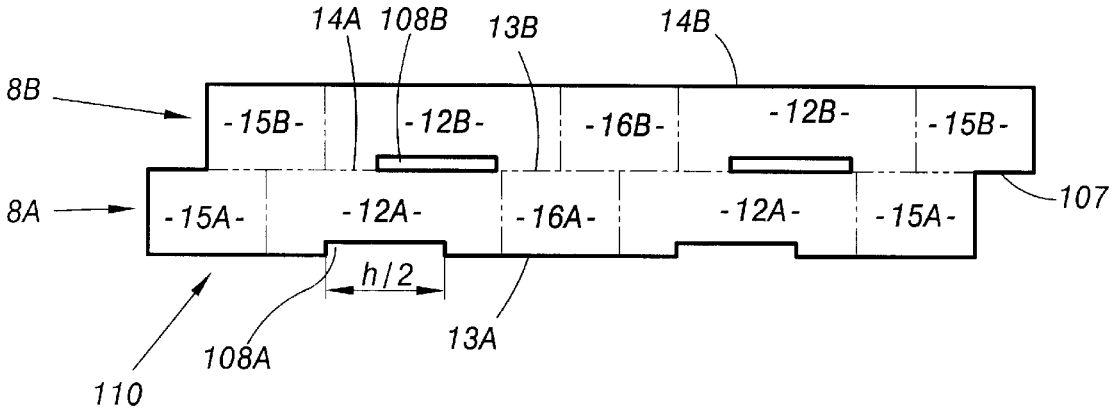

Exemplary embodiments of the invention will now be described with reference to FIGS. 3 to 7 of the appended drawings, in which:

FIG. 3 schematically depicts the bending and perforating tools and the associated command and control means;

FIG. 4 depicts, in perspective, a corrugated fin to which the invention may advantageously apply;

FIG. 5 depicts, in plan view, a flat sheet for the manufacture of the corrugated fin of FIG. 4; and FIGS. 6 and 7 are views respectively similar to FIGS. 4 and 5 and corresponding to another type of corrugated fin at which the invention is particularly aimed.

DESCRIPTION OF THE PREFERRED EMBODIMENTS

A device that is the subject of one particular embodiment of the invention will be described first of all with reference to FIG. 3.

This device comprises a perforating tool 30 equipped with a perforating actuator 32 fixed to a support structure 33 of the perforating tool 30, and a punch 35 secured to the moving rod of the actuator 32. The perforating tool 30 has an entry 37 and an exit 38 through which a continuous metal product in sheet form that is to be treated passes. The perforating tool 30 has means of guiding the metal sheet, these means not being depicted, which allow the metal sheet to travel uniformly and stepwise through the tool, in an approximately horizontal plane. The perforating actuator 32 drives the punch 35 in reciprocating vertical movement associated with the movement of the metal sheet. The punch 35, through collaboration with a die counterpart 39, thus perforates the metal sheet at regular intervals.

The device also comprises a bending tool 40 comprising a bending actuator 42 fixed to a support structure 43 of the bending tool 40, and the moving rod of which is secured to a bending member 45 with reciprocating vertical movement, such as a bar, which collaborates with a tool counterpart, not depicted. The bending tool 40 has an entry 42 and an exit 48, the entry 47 directly receiving the perforated metal sheet leaving the exit 38 of the perforating tool 30. The bending tool 40 has means for guiding and driving the metal sheet, the drive means being designed to cause the metal sheet to progress at a step size and speed which are appropriate to the bending operation. These guide and drive means are of conventional type and have not been depicted.

The bending tool 40 is stationary with respect to a stationary support 50, while the perforating tool 30 can move, by virtue of wheels 51 or any appropriate device such as slideways, in terms of translation in the horizontal direction X—X of travel of the metal sheet. The perforating tool 30 is driven in translation by an actuator 55 in the direction of travel of the metal sheet or in the opposite direction. The actuator 55 is secured, via its stationary part, to the support structure 43 of the bending tool 40, and by its moving rod, to the support structure 33 of the perforating tool 30.

The device further comprises command and control means 60 capable of commanding the operation of the perforating 32 and bending 42 actuators, and the operation of the actuator 55, in response to measured and/or pre-recorded parameters.

The command and control means 60 for this purpose comprise a position sensor 62 located in the bending tool 40 and designed to constantly monitor the relative position of the perforations with respect to the bends, and to formulate a detection signal S0 signifying this relative position.

The command and control means 60 also comprise a first movement sensor 64 secured to the support structure 33 of the perforating tool 30 and designed to detect the movement of the metal sheet with respect to the said support structure of the perforating tool 30 and to generate a signal S1 signifying this movement.

Likewise, the command and control means 60 comprise a second movement sensor 66 which is stationary with respect to the support structure 43 of the bending tool 40 and designed to detect the movement of the metal sheet with respect to the bending tool 40 at its entry 47. The said second sensor 66 generates a signal S2 signifying this movement.

The command and control means 60 finally comprise a computer 70 connected to the position sensor 62, to the first movement sensor 64 and to the second movement sensor 66, so as to receive their receptive detection signals S0, S1 and S2. The computer 70 is also designed to receive other pre-recorded parameters $P_i$ and preprogrammed control laws $L_i$. The computer 70 emits to the perforating 32 and bending 42 actuators and to the actuator 55, respective command signals C1, C2 and C3 formulated from the detection signals S0, S1, S2, from the external pre-recorded parameters $P_i$ and from the control laws $L_i$.

The way in which the device works will now be described in greater detail, it being clearly understood that this operation is repeated a great many times and at high speed throughout the time that the metal sheet spends passing through the tools.

First of all, in order to carry out precise perforating and bending operations, the perforating actuator 32 can be activated in the direction of lowering the punch 35 only if the first movement sensor 64 detects that the metal sheet is immobile with respect to the perforating tool 30; further, the bending actuator 42 can be activated only if the second movement sensor 66 detects an absence of movement of the metal sheet with respect to the support structure 43 of the bending tool 40.

The command signals C1, C2 for the respective actuators 32, 42 of the perforating 30 and bending 40 tools are synchronized by the computer 70 so that a bending operation can be performed only when the punch 35 is in the raised position, that is to say when the metal sheet is released from the perforating tool 30.

The actuator 55, for its part, adjusts the separation between the perforating tool 30 and the bending tool 40 as a function of the measurement, by the position sensor 62, of the position of the perforations 20 with respect to the corrugation 8 downstream of the bending member 45. That is to say that the position of the perforating tool 30 is slaved to the position of the perforations 20 on the corrugation 8.

The pre-recorded parameters $P_i$ and the control laws $L_i$ correspond, for their part, to the datum for the positioning of the perforations 20 with respect to the corrugations 8. These laws and parameters vary according to the type of corrugation to be produced and to the desired thermal performance of the corrugated fin or desired flow characteristics for the fluid.

The device which has just been described allows continuous adjustment of the relative positions of the perforating 30 and bending 40 tools on the basis of parameters taken from the finished product. What happens is that an operating cycle of the perforating 30 and bending 40 tools arranged at the following tooling, takes place as follows: the metal sheet is caused to travel by one perforation step and the travel is halted so that a bending operation can be performed. The position of the perforating tool is then adjusted with respect to the bending tool. When the perforating tool 30 is immobilized, a perforating operation is performed if all the identical parts of one and the same corrugation 8 are to be perforated. If not, this same cycle is repeated or the operation is halted, depending on the intended perforation pattern preprogrammed using the control laws $L_i$ and the external pre-recorded parameters $P_i$.

By way of example, the preprogrammed perforation pattern may correspond to a hybrid structure in which perforations are arranged alternately so that corrugation passages alternately communicate and are sealed. This structure is used for producing multi-pass cross-flow exchangers.

According to need, the perforations may be placed in the corrugation legs and/or in the corrugation crests or troughs and/or in the bends.

One particularly beneficial application of the invention is in producing exchangers comprising a corrugation placed in such a way that its main direction of corrugation is perpendicular to the direction in which the fluid flows, this configuration being known as the "hard-way" configuration, with a view to providing better control over the distribution of fluid in the exchanger.

Of course, the perforations may adopt various shapes, for example round, rectangular or oblong shapes, but may alternatively be in the form of notches provided on at least some leading edges and/or some trailing edges of the corrugation legs and possibly the corrugation troughs and/or crests.

The invention is thus particularly well suited to producing notched offset corrugations like those depicted in FIGS. 4 and 6.

With reference to FIG. 4, the corrugation 8 comprises a great many rows of adjacent corrugations, just two, 8A, 8B, of which have been depicted. These corrugation rows 8A, 8B are separated by an offset line 107. Each leg 12A, 12B has a notch 108A, 108B on its only leading edge 13A, 13B. This notch 108A, 108B extends from the trough 16A, 16B to mid-way up the height, that is to say to the level h/2, h being the height of the corrugation.

FIG. 5 depicts in plan view the corresponding band of a metal sheet 110 used to produce such a fin. The bend lines have been marked on these Figures, even though they are virtual, and the corresponding parts of the fin after bending have been marked thereon.

As depicted in FIG. 5, the corrugated fin of FIG. 4 is obtained by forming, in the sheet 110, elongate rectangular perforations or cutouts 108 adjacent to the leading edge 13 of the legs 12 of each row 8, always on one and the same side of the offset lines 107. All the cutouts 108 have the length h/2 and start from the troughs 15.

As an alternative, of course, the cutouts 108 could have a length other than h/2.

The embodiment of FIGS. 6 and 7 differs from that of FIGS. 4 and 5 only in that the notches 108, which once again have the length h/2, are provided midway along the length of the leading edges 13A, 13B of the legs 12A, 12B. The cutouts 108 are shifted accordingly (FIG. 7).

As an alternative, through a careful choice of the size and position of the cutouts, it is possible to obtain, on the corrugated fin, notches which are located, as desired, on at least part of the leading edges, the trailing edges, the corrugation crests and/or the corrugation troughs, or some of these.

It will be appreciated that, by virtue of the device and method which have just been described, the perforations are arranged uniformly and without significant drift with respect to the datum. The accuracy with which the perforations are positioned on the corrugation is thus free of the problems of the elongation of the metal, which problems were due in particular to the bending operation and to the nature of the alloy used, and of the problems of the slippage of the metal sheet in the means for guiding and moving the sheet.

High-quality heat-exchanger corrugations, the characteristics of which are perfectly controlled and reproducible, can thus be manufactured in a way which is satisfactory from the point of view of the complexity of the tooling and of the production rates.

What is claimed is:

1. A method for manufacturing, from a flat product in sheet form, a corrugated fin for a plate-type heat exchanger comprising at least one corrugation (8), the corrugation (8) having corrugation legs (12) connecting corrugation crests (15) and corrugation troughs (16), the corrugation (8) having a series of perforations (20), the method comprising the steps of:

positioning a perforating tool at a distance from a bending tool;

making perforations using the perforating tool in the flat product to make a perforated product;

passing the perforated product from the perforating tool (30) to the bending tool (40);

forming a corrugation that includes the perforations; and after forming the corrugation, changing the relative position of the perforating tool and the bending tool in a direction of travel (X—X) of the perforated product, the step of changing the relative position comprising detecting a position of a perforation (20) on the corrugation (8), and adjusting the relative position of the perforating tool and the bending tool (30, 40) based on the detected position of the corrugation.

2. The method of claim 1, wherein steps of passing the perforated product comprises the steps of:

carrying out a bending operation with the bending tool to form the corrugation;

adjusting the relative position of the perforating tool (30) and of the bending tool (40) as a function of a detected position of a perforation (20) on the corrugation (8).

3. The method of claim 1, wherein steps of passing the perforated product comprises the steps of:

detecting a movement of the flat product with respect to the perforating tool (30); and permitting a perforating operation only when the flat product is immobile with respect to the perforating tool (30).

4. The method of claim 2, comprising the further steps of:

detecting a movement of the flat product with respect to the bending tool (40); and permitting a bending operation only when the flat product is immobile with respect to the bending tool (40).

5. The method of claim 2, wherein each of plural passing steps comprises an earlier perforating operation.

6. The method of claim 1, wherein, in the adjusting the relative position step, the bending tool is held stationary and the perforating tool is moved relative to the bending tool.

7. A method of manufacturing a corrugated sheet, comprising the steps of:

positioning a flat sheet through a movable perforating tool and into a bending tool, the perforating tool being movable with respect to the bending tool in a horizontal direction of travel of the sheet, the perforating tool being equipped with a perforating actuator attached to a punch, the bending tool being equipped with a bending member;

perforating the sheet with the punch to form perforations within a perforated sheet section;

with the bending member, forming a corrugation including the perforated sheet section;

making a measurement of a position of the perforations with respect to the corrugation and adjusting a separation between the perforating tool and the bending tool as a function of the measurement.

8. The method of claim 7, wherein the measurement of the position of the perforations with respect to the corrugation is made downstream of the bending member.

9. The method of claim 7, wherein the perforating actuator is actuated only when detecting that the sheet is immobile with respect to the perforating tool; and the bending member is actuated only when detecting an absence of movement of the sheet with respect to the bending tool.

10. A method of manufacturing a corrugated fin, comprising the sequential steps of:

a) positioning a movable perforating device relative to a bending device;

b) perforating a sheet with the perforating device to form perforations in a perforated sheet section;

c) moving the perforated sheet section into the bending device;

d) with the bending tool, forming a corrugation including the perforated sheet section;

e) making a measurement of a position of the perforations with respect to the corrugation and adjusting a separation between the perforating tool and the bending tool as a function of the measurement; and f) repeating steps b) through e).

* * * * *